US010919721B2

(12) United States Patent
Kai et al.

(10) Patent No.: US 10,919,721 B2
(45) Date of Patent: Feb. 16, 2021

(54) IMAGE FORMING APPARATUS AND SHEET FEEDING APPARATUS

(71) Applicant: CANON KABUSHIKI KAISHA, Tokyo (JP)

(72) Inventors: Teruhito Kai, Abiko (JP); Hiroto Nishihara, Tsukuba (JP); Hiromi Shimura, Toride (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/576,268

(22) Filed: Sep. 19, 2019

(65) Prior Publication Data

US 2020/0095081 A1 Mar. 26, 2020

(30) Foreign Application Priority Data

Sep. 20, 2018 (JP) ..... JP2018-175997

(51) Int. Cl.

| | |
|---|---|
| ***B65H 1/14*** | (2006.01) |
| ***B65H 7/20*** | (2006.01) |
| ***B65H 3/06*** | (2006.01) |
| ***B65H 1/18*** | (2006.01) |

(52) U.S. Cl.

CPC ..... *B65H 7/20* (2013.01); *B65H 1/18* (2013.01); *B65H 3/06* (2013.01)

(58) Field of Classification Search

CPC ..... B65H 7/20; B65H 1/18; B65H 2511/511; B65H 2601/525; B65H 1/08; B65H 1/04; B65H 1/266

See application file for complete search history.

(56) References Cited

U.S. PATENT DOCUMENTS

| | | | | |
|---|---|---|---|---|
| 8,180,234 | B2 | 5/2012 | Takahashi et al. | |
| 8,743,431 | B2 * | 6/2014 | Hayasaka | G03G 15/607 271/114 |
| 10,239,717 | B2 | 3/2019 | Kai et al. | |
| 10,308,458 | B2 | 6/2019 | Takahashi et al. | |
| 2006/0197276 | A1 * | 9/2006 | Tanaka | B65H 1/14 271/118 |

FOREIGN PATENT DOCUMENTS

| | | | |
|---|---|---|---|
| JP | 9-30662 | * | 2/1997 |
| JP | 11-189344 | A | 7/1999 |

OTHER PUBLICATIONS

Machine Translation of JP 9-30662 (Year: 1997).*

* cited by examiner

*Primary Examiner* — Thomas A Morrison
(74) *Attorney, Agent, or Firm* — Venable LLP

(57) ABSTRACT

An image forming apparatus includes a manual feed tray for placing a sheet to be subjected to image formation; a pickup roller configured to abut against the placed sheet to feed the sheet; a controller; and a human detection sensor. The controller maintains an abutment state, in which the pickup roller is held in abutment against the sheet, until a time period during which the abutment state is maintained reaches an abutment timeout. When a time period during which no human is detected by the human detection sensor in the vicinity of the image forming apparatus reaches a human detection timeout even before the time period during which the abutment state is maintained reaches the abutment timeout, the controller brings the pickup roller into a non-abutment state against the sheet.

11 Claims, 9 Drawing Sheets

| | TIMEOUT TIME [SECONDS] |
|---|---|
| ABUTMENT TIMER | 60 |
| HUMAN DETECTION TIMER | 5 |

IMAGE FORMING APPARATUS AND SHEET FEEDING APPARATUS

BACKGROUND OF THE INVENTION

Field of the Invention

The present disclosure relates to a sheet feeding control to be performed in an image forming apparatus configured to perform image formation, such as a copying machine or a printer, and in a sheet feeding apparatus configured to feed a sheet such as a printing sheet.

Description of the Related Art

There are known a sheet feeding apparatus configured to feed a sheet and an image forming apparatus including a sheet feeding apparatus, which is configured to perform image formation on a sheet fed by the sheet feeding apparatus. As the image forming apparatus including a sheet feeding apparatus, for example, there are known a copying machine and a printer, which are configured to perform image formation on a recording material by an electrophotographic method. The image forming apparatus is configured to feed a printing sheet placed in a sheet feeding cassette or on a sheet feeding tray (manual sheet feeding tray), and to perform the image formation on the printing sheet.

In the sheet feeding cassette, a sheet of a fixed size such as A4 size or a sheet having a standard basis weight is placed and automatically fed. Meanwhile, there exist various types of printing sheets to be fed. When image formation is performed on a thick printing sheet having a large basis weight which cannot be accommodated in or fed from the sheet feeding cassette, a coated printing sheet having a slippery surface, a sheet of a non-fixed size, or an elongated sheet, the sheets described above are placed on the sheet feeding tray to perform the image formation.

In Japanese Patent Application Laid-open No. Hei 11-189344, there is disclosed an image forming apparatus including a manual sheet feeding apparatus to be used as a sheet feeding tray. The image forming apparatus has two modes, and any one of the two modes can be selected. In one mode, a bottom plate of the manual sheet feeding apparatus is lowered to a position at which sheet feeding cannot be performed every time the image formation ends. In another mode, the bottom plate of the manual sheet feeding apparatus is held at a raised position at which sheet feeding can be performed even after the end of the image formation. When the image forming apparatus detects that the manual sheet feeding apparatus is out of printing sheets during the image formation, the bottom plate is lowered to enable refill of printing sheets so as to urge quick sheet feeding, thereby improving operability for a user.

In the image forming apparatus disclosed in Japanese Patent Application Laid-open No. Hei 11-189344, when the mode for holding the bottom plate at the raised position at which sheet feeding can be performed even after the end of the image formation is selected, the bottom plate of the manual sheet feeding apparatus is lowered at a time when it is detected that the manual sheet feeding apparatus is out of sheets.

Specifically, as long as a sheet is left in the manual sheet feeding apparatus, the bottom plate of the manual sheet feeding apparatus is held at the raised position. Thus, the sheet and a sheet feeding roller are maintained in an abutment state. Thus, a stress is constantly applied to the sheet.

In particular, the coated printing sheet has a special surface finish. When the coated printing sheet is placed under a state in which the sheet feeding roller is kept in an abutment state for a long period of time, for example, there is a risk in that a roller trace becomes more liable to be left on a surface of the sheet, with the result that image quality of a resultant sheet after the image formation may be affected.

SUMMARY OF THE INVENTION

An image forming apparatus according to the present disclosure includes: a sheet feeding tray on which a sheet to be subjected to image formation is placed; a sheet feeder configured to abut against the sheet placed on the sheet feeding tray to feed the sheet; a moving unit configured to move at least one of the sheet feeder and the sheet feeding tray to achieve one of an abutment state in which the sheet feeder is held in abutment against the sheet on the sheet feeding tray and a separated state in which the sheet feeder is not held in abutment against the sheet on the sheet feeding tray; a human detector configured to detect a human being present in a vicinity of the image forming apparatus; and a controller configured to control, in a case where the human detector detects a human, a relative position between the sheet feeder and the sheet feeding tray with use of the moving unit to maintain the abutment state until a first time period reaches a first predetermined time period, the first time period being a time period during which the sheet feeder is maintained in the abutment state, wherein, in a case where a second time period reaches a second predetermined time period that is shorter than the first predetermined time period, the sheet feeder is brought into the separated state with use of the moving unit even before a first time period reaches the first predetermined time period, the second time period being a period during which no human is detected in the vicinity of the image forming apparatus by the human detector under a state in which the abutment state is maintained.

Further features of the present invention will become apparent from the following description of exemplary embodiments (with reference to the attached drawings).

DESCRIPTION OF THE EMBODIMENTS

Figure 1:
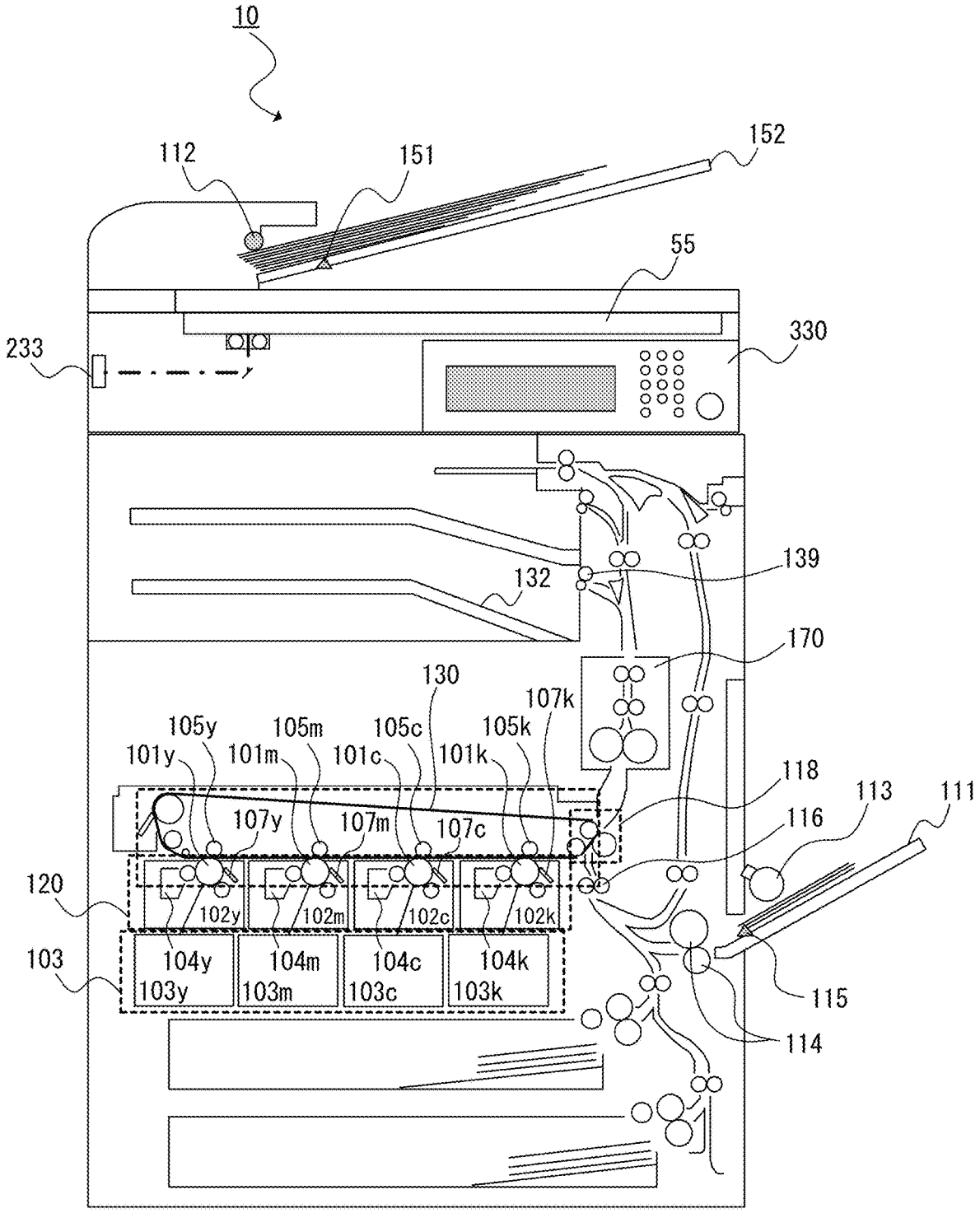
FIG. 1 is a sectional view of an image forming apparatus according to an embodiment of the present disclosure.

Now, an image forming apparatus according to one embodiment of the present disclosure is described with reference to the accompanying drawings. FIG. 1 is a sectional view of the image forming apparatus according to this embodiment, and FIG. 2 is a control block diagram of the image forming apparatus according to this embodiment.

<Schematic Configuration of Image Forming Apparatus>

As illustrated in FIG. 1, the image forming apparatus 10 according to this embodiment can form a color image with toners of four colors, that is, a plurality of colors including yellow (y), magenta (m), cyan (c), and black (k). Further, image formation can also be performed with one color (single color) selected from among the toners of four colors. In this description, an exemplary case is described in which single color image formation is monochromatic printing (black).

Figure 2:
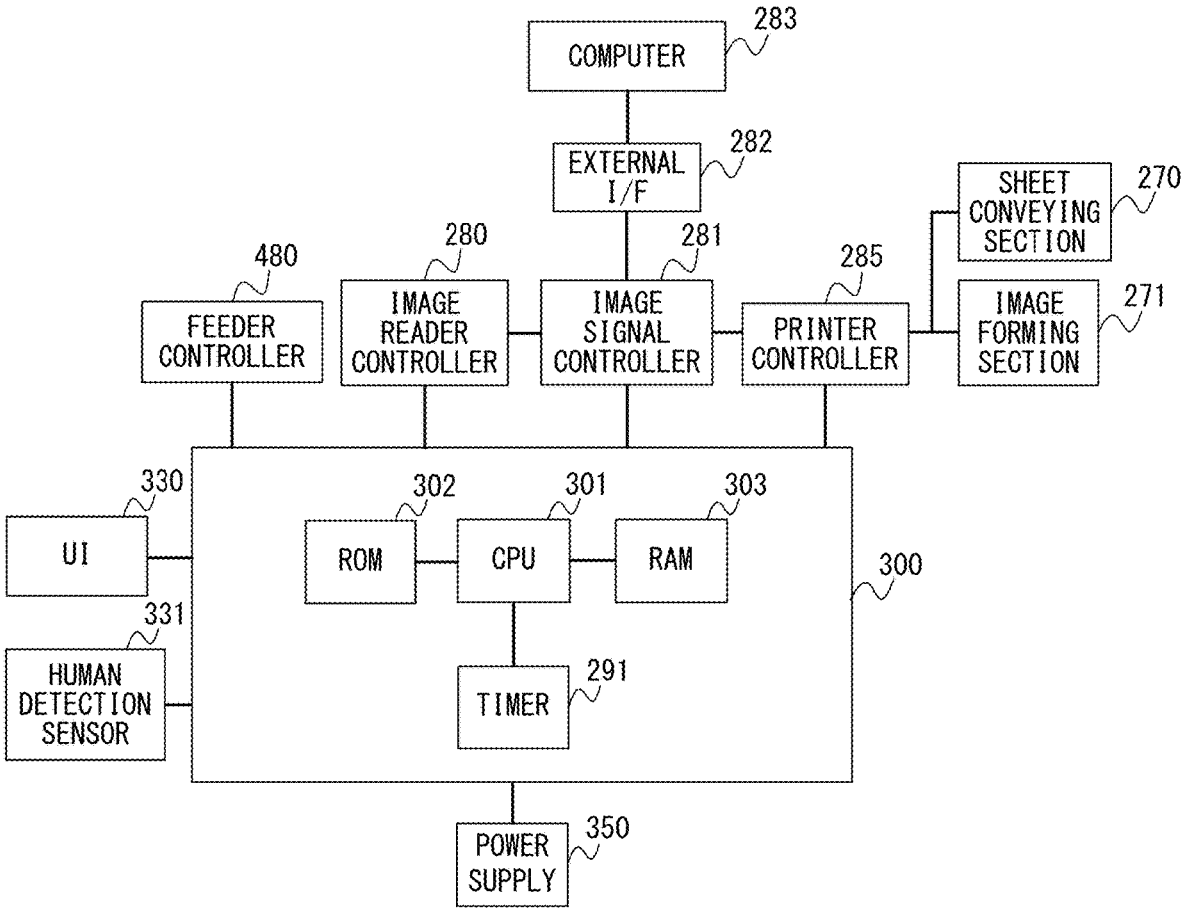
FIG. 2 is a control block diagram of the image forming apparatus according to the embodiment of the present disclosure.

Further, the image forming apparatus 10 can be connected to a computer 283 or other devices (for example, a facsimile machine) through an external IF 282 illustrated in FIG. 2.

The image forming apparatus 10 includes laser scanner units 103, primary transfer rollers 105 (*y, m, c*, and *k*) serving as transfer members, an intermediate transfer belt 130 which is one example of a transfer belt, and a fixing unit 170. Further, the image forming apparatus 10 includes a manual feed tray 111 configured to receive a sheet (e.g., a printing sheet) serving as a sheet feeding tray. Now, an example of using a printing sheet as a sheet is described.

The image forming apparatus 10 further includes a pickup roller 113 configured to operate as a sheet feeder, sheet feeding rollers 114, a sheet sensor 115 serving as a sheet detector, a registration roller 116, a secondary transfer unit 118, image forming units 120, and a sheet delivery roller 139. Yet further, the image forming apparatus 10 includes a sheet delivery tray 132, an operation unit 330, an original tray 152, an original conveying roller 112, an original presence/absence sensor 151, an image sensor 233, and an original glass 55. The sheet sensor 115 detects whether or not a printing sheet is present on the manual feed tray 111.

The image forming units 120 include photosensitive drums 101 (*y, m, c*, and *k*), charging rollers 102 (*y, m, c*, and *k*), developing units 104 (*y, m, c*, and *k*), and photosensitive drum cleaners 107 (*y, m, c*, and *k*), respectively. The image forming units 120 (*y, m, c, k*) include a yellow image forming unit 120*y*, a magenta image forming unit 120*m*, a cyan image forming unit 120*c*, and a black image forming unit 120*k*.

The controller 300 illustrated in FIG. 2 includes a CPU (Central Processing Unit) 301, a ROM (Read Only Memory) 302, a RAM (Random Access Memory) 303, and a timer 291. Further, the controller 300 receives power from a power source 350. The CPU 301 of the controller 300 executes control of the image forming apparatus 10. The ROM 302 storing a control program written therein and the RAM 303 configured to store variables for use in the control and image data read by the image sensor 233 are connected to the CPU 301 through an address bus and a data bus. The timer 291 is capable of counting time, and is connected to the CPU 301. The CPU 301 sets a time count value for the timer 291 and obtains a timer measurement value from the timer 291.

The CPU 301 controls to drive the original conveying roller 112 through a feeder controller 480 and detect presence of an original through the original presence/absence sensor 151. Further, the CPU 301 detects opening and closing operations of an original pressing plate through an image reader controller 280. Further, the CPU 301 obtains an image of an original on the original glass 55 or an image of an original fed by the feeder controller 480 through the image sensor 233. After that, the CPU 301 transfers an analog image signal obtained from the image sensor 233 to an image signal controller 281.

During a copying operation, the image signal controller 281 executes processing which is necessary for the copying operation after converting the analog image signal from the image sensor 233 into a digital image signal, converts the processed digital image signal into a video signal, and outputs the video signal to a printer controller 285. Further, during the printing operation, the image signal controller 281 executes various necessary processing to a digital image signal input from the computer 283 through the external IF 282, converts the digital image signal into a video signal, and outputs the video signal to the printer controller 285.

The printer controller 285 instructs image formation to the image forming section 271 based on an instruction from the CPU 301. The image forming section 271 drives the image forming units 120 in accordance with the input video signal. Further, in accordance with an instruction from the CPU 301, the printer controller 285 controls a sheet conveying section 270 to feed and convey a printing sheet. More specifically, whether or not the printing sheet is present on the manual feed tray 111 illustrated in FIG. 1 is detected with use of the sheet sensor 115. When the presence of the printing sheet is detected, a lowering operation of the pickup roller 113 is performed with use of a raising and lowering motor 163 as a drive source. Thereafter, the pickup roller 113 and the sheet feeding rollers 114 are driven to rotate with use of a sheet feeding conveyance motor 164 as a drive source to feed the printing sheet.

The operation unit 330 is provided as a user interface unit of the image forming apparatus 10. Through the operation unit 330, a user gives instructions, such as selection of a color mode in image formation, indication of a state of the image forming apparatus 10, and start of copying. When the CPU 301 detects that a printing sheet is set on the manual feed tray 111, the CPU 301 causes a sheet size selection screen to be displayed on the operation unit 330. The mode setting selected through this operation is stored in the RAM 303.

Further, a human detection sensor 331 corresponding to human detection means is an infrared sensor array including infrared sensors configured to receive infrared light, and being arranged in a matrix pattern. The human detection sensor 331 is arranged at a predetermined position on a front-surface side of the image forming apparatus 10. The CPU 301 detects reception of the infrared light emitted from, for example, a human body through the human detection sensor 331 to detect whether or not a human is present in the vicinity of the image forming apparatus 10.

In this embodiment, there is described an example in which the human detection sensor 331 corresponding to the human detection means detects a human. However, any object that emits the infrared light can be detected by the human detection sensor 331. Further, the human detection sensor 331 is not limited to the infrared sensor described above, and may be a suitable human detection sensor configured to detect the presence of a human with use of an ultrasonic wave or visible light. Further, a sensor configured to detect not only a human but also some object approaching the image forming apparatus may be used. Even in this case, a suitable device other than the infrared sensor may be used.

For example, a light sensor to detect light, a strain sensor which is deformed by a physical force, a magnetic sensor to detect magnetism, a temperature sensor to detect a temperature, or an ultrasonic sensor to detect an ultrasonic wave may be used.

The basic image forming operation and the human-body detection, which are described above, are merely examples, and the present disclosure is not limited to the configurations described above.

<Basic Image Forming Operation of Image Forming Apparatus>

Next, a basic image forming operation is described with reference to FIG. 1 and FIG. 2. Unless otherwise noted, the following operation is executed by the CPU 301.

When the CPU 301 detects that a printing sheet is set on the manual feed tray 111 by the sheet sensor 115, the CPU 301 causes the sheet size selection screen to be displayed on the operation unit 330 to accept selection and determination of the sheet size, which have been input by the user through the operation unit 330. Thereafter, the CPU 301 controls raising and lowering operations of the pickup roller 113 to move the pickup roller 113 to a pickup roller abutment position. At the pickup roller abutment position, the pickup roller 113 is brought into abutment against the printing sheet placed on the manual feed tray 111 to form a nip. Hereinafter, a state in which the pickup roller 113 is brought into contact with the printing sheet to enable sheet feeding is described as "abutment state", and other states including a state in which the pickup roller 113 is not held in contact with the printing sheet are described as "non-abutment state".

In this embodiment, in order to bring the pickup roller 113 into the abutment state, the raising and lowering motor 163 is provided as a moving mechanism configured to raise and lower the pickup roller 113. A position of the pickup roller 113 in the abutment state is described as the "abutment position", and a position of the pickup roller 113 other than the abutment position is described as the "non-abutment position". However, the present disclosure is not limited to the configuration described above. A suitable configuration for changing a relative position between the manual feed tray 111 and the pickup roller 113 may be adopted. For example, the raising and lowering motor 163 may be used as a moving mechanism for raising and lowering the manual feed tray 111, or moving mechanisms respectively configured to move the pickup roller 113 and the manual feed tray 111 may be separately provided. Further, in this embodiment, the sheet feeding conveyance motor 164 is used to move the pickup roller 113. However, a manual feed tray moving motor configured to move the manual feed tray 111 with respect to the pickup roller 113 may be further provided. In this case, the sheet feeding conveyance motor 164 and the manual feed tray moving motor form moving means for moving at least one of the pickup roller 113 and the manual feed tray 111.

When print setting instructions of a color mode, the number of prints, and other settings from, for example, the operation unit 330 are input to the CPU 301 or the CPU 301 detects opening and closing of the original pressing plate or placement of an original through the feeder controller 480 or the image reader controller 280, the CPU 301 performs a print preparation operation.

During the print preparation operation, the CPU 301 starts a temperature adjustment control for the fixing unit 170. When a size of a printing sheet on the manual feed tray 111 is determined and the position of the pickup roller 113 is not the "pickup roller abutment position", the CPU 301 moves the pickup roller 113 to the "pickup roller abutment position". A moving operation of the pickup roller 113 and the print preparation operation are described later in detail.

Next, after an instruction to start the printing operation is input, the CPU 301 starts reading of the original through the feeder controller 480. The CPU 301 drives the original conveying roller 112 to convey the original from the original tray 152 to a position above a platen glass and radiates light of a lamp (not shown) to the original through the platen glass. Reflected light from the original is guided to the image sensor 233 through a mirror, and image data of the original read by the image sensor 233 is output to the image signal controller 281. Reading of the original is continued until reading of the original on the original glass 55 is completed or until reading of the last original detected by the original presence/absence sensor 151 is completed.

Meanwhile, the CPU 301 controls the image forming units 120 (*y, m, c*, and *k*) through the image forming section 271 to start image forming operation of image data stored in the RAM 303.

The image forming units 120 (*y, m, c*, and *k*) include the photosensitive drums 101 (*y, m, c*, and *k*), the developing units 104 (*y, m, c*, and *k*), the charging rollers 102 (*y, m, c*, and *k*), and the photosensitive drum cleaners 107 (*y, m, c*, and *k*), respectively. In the image forming units 120 (*y, m, c*, and *k*), surfaces of the photosensitive drums 101 are charged, and latent images are formed on the photosensitive drums 101 by laser beams radiated from the laser scanner units 103.

The formed latent images are developed on the photosensitive drums 101 by the toners in the developing units. After that, toner images developed on the photosensitive drums 101 are applied with a primary transfer voltage at a monochromatic primary transfer roller 105 (*k*) and color primary transfer rollers 105 (*y, m*, and *c*) and transferred onto the intermediate transfer belt 130. The toner images transferred onto the intermediate transfer belt 130 reach the secondary transfer unit 118 through rotation of the intermediate transfer belt 130. The CPU 301 drives a convey motor (not shown) which serves as a drive source for the pickup roller 113, the sheet feeding rollers 114, the registration rollers 116, and the sheet delivery rollers 139 through the sheet conveying section 270. This driving is performed so as to coincide with the timing at which the toner images arrive at the secondary transfer unit 118. As a result, the pickup roller 113 is driven to rotate, and hence printing sheets are fed and conveyed one after another from the manual feed tray 111.

In such a manner as described above, the secondary transfer voltage is applied to the printing sheet and the toner images having reached the secondary transfer unit 118, to thereby transfer the toner images to the printing sheet. The printing sheet after the secondary transfer is conveyed to the fixing unit 170 and the toner images on the printing sheet are heated and fixed on the printing sheet. After that, the CPU 301 performs delivery of the printing sheet to the sheet delivery tray 132 through the sheet delivery roller 139 controlled by a sheet feeding unit. After the printing operation is completed, the CPU 301 causes the pickup roller 113 to be moved upward from the abutment position held in abutment against the manual feed tray 111 to the non-abutment position.

<Description of Raising and Lowering Operations of Pickup Roller 113>

Next, a raising and lowering mechanism for the pickup roller 113 according to this embodiment is described. In this embodiment, the position of the pickup roller 113 is switched between the abutment position and the non-abutment position by raising and lowering the pickup roller 113. However, the switching between the abutment position and the non-abutment position may be performed with a suitable technique.

<Description of Manual Feed Tray 111>

Now, a configuration to detect a printing sheet placed on the manual feed tray 111 according to this embodiment is described.

Figure 3A:
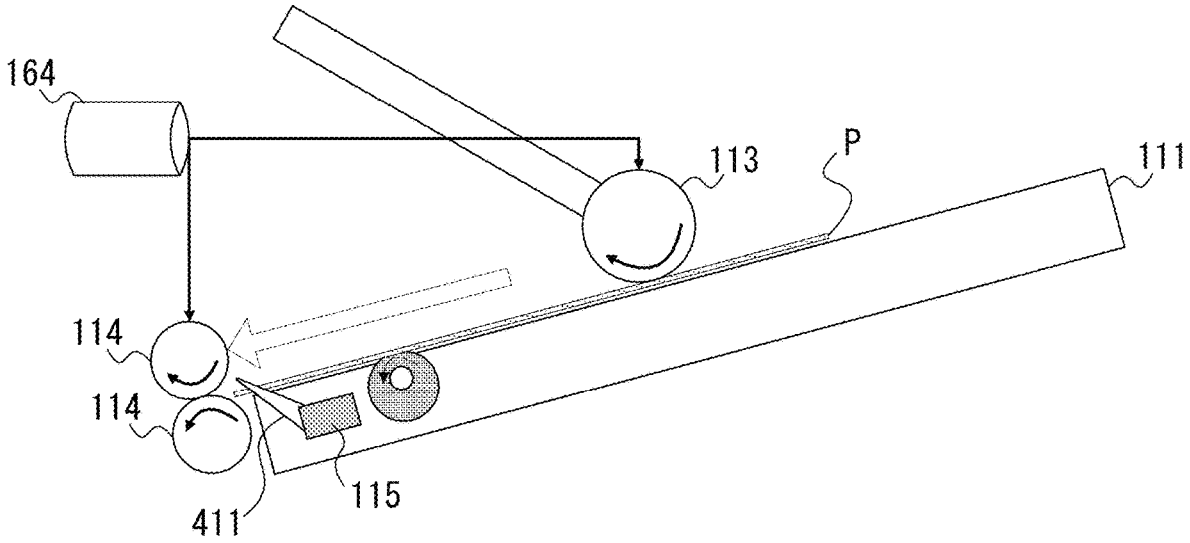
FIG. 3A is a sectional view of a manual feed tray and the vicinity thereof.

FIG. 3A is a sectional view for illustrating the manual feed tray 111 and the vicinity thereof. As illustrated in FIG. 3A, when a printing sheet indicated by the reference symbol P in FIG. 3A is set on the manual feed tray 111, a sheet flag 411 configured to detect the presence of the printing sheet P is pushed and moved by the printing sheet P and shades the sheet sensor 115. When the sheet sensor 115 is shaded, the sheet sensor 115 detects that the printing sheet P is present on the manual feed tray 111. As a result, the CPU 301 determines that the printing sheet P is placed on the manual feed tray 111. When the printing sheet is set on the manual feed tray 111, the CPU 301 causes the sheet size selection screen to be displayed on the operation unit 330. Details of display on the operation unit 330 are described later. Further, when the sheet feeding conveyance motor 164 is rotated while the pickup roller 113 is located at the abutment position at which the pickup roller 113 is held in abutment against the printing sheet, the pickup roller 113 and the sheet feeding rollers 114 are rotated to feed and convey the printing sheet in a direction indicated by the outlined arrow.

Figure 3B:
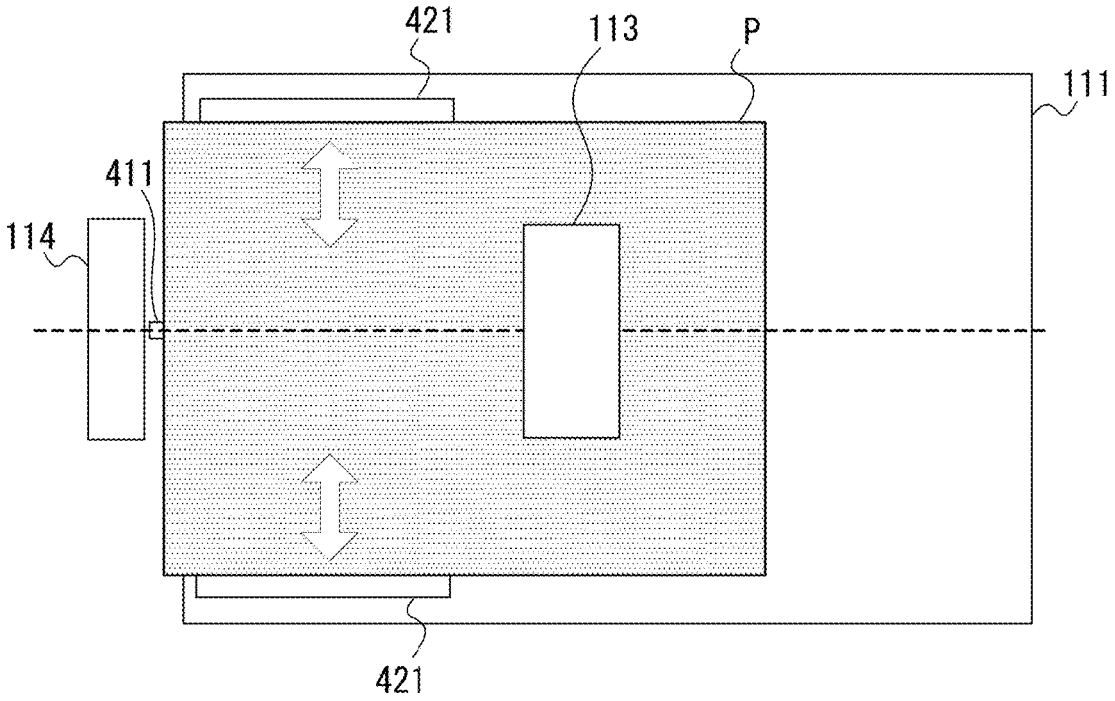
FIG. 3B is a projection view of the manual feed tray and the vicinity thereof when viewed from above.

FIG. 3B is a projection view of the manual feed tray 111 when viewed from above. As illustrated in FIG. 3B, side regulating plates 421 configured to be movable in parallel to the manual feed tray 111 in directions indicated by the arrows are arranged on the manual feed tray 111. The side regulating plates 421 are configured to sandwich a printing sheet from both of a rear side and a front side of the image forming apparatus 10 to adjust an orientation of the printing sheet set on the manual feed tray 111 in alignment with a conveying direction. Further, with the configuration described above, a center axis of the printing sheet in a longitudinal direction thereof is aligned with a center axis of the image forming units 120 in a longitudinal direction thereof as illustrated in FIG. 1. As a result, the image formation is performed at a correct image position on the printing sheet fed from the manual feed tray 111. Further, positions of the side regulating plates 421 can be detected with use of a position sensor (not shown). The CPU 301 detects a size of the printing sheet based on the positions of the side regulating plates 421 and changes contents of display on the sheet size selection screen displayed on the operation unit 330. Display on the display unit 330 is described later.

<Description of Operation Unit 330>

<Size Determining>

Figure 4A:
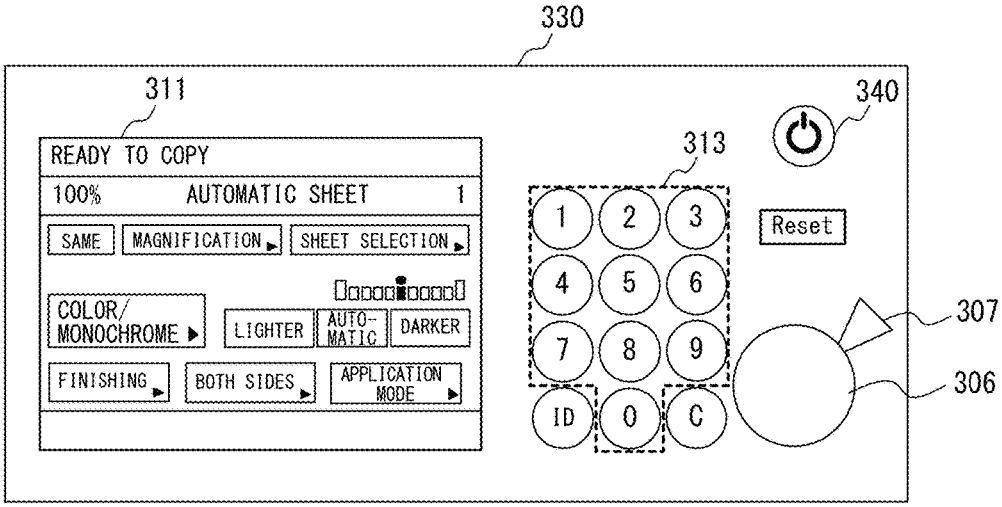
FIG. 4A is a front view of an operation unit.

FIG. 4A is a front view of the operation unit 330 according to this embodiment. On the operation unit 330, there are arranged a start key 306 for starting the copying operation, a stop key 307 for stopping the copying operation, numerical keys 313 for performing setting of the number of prints, and a power button 340. Further, on the operation unit 330, there is also arranged a display portion 311 having a touch panel. Soft keys can be displayed on the operation unit 330. The CPU 301 executes a print preparation operation control in response to the operation performed by the user on, for example, the numerical keys 313 for performing setting of the number of prints.

Figure 4B:
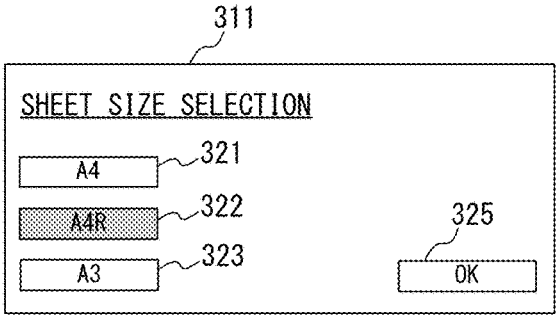
FIG. 4B and FIG. 4C are explanatory diagrams of a sheet selection screen.
Figure 4C:
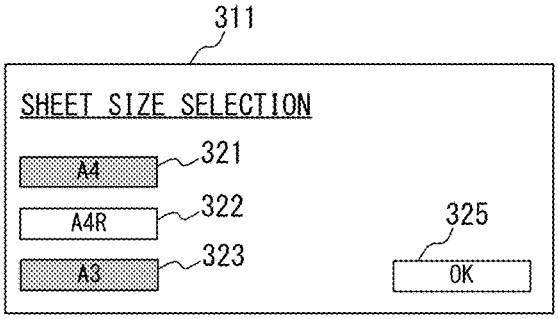

FIG. 4B and FIG. 4C are explanatory diagrams of the sheet size selection screen displayed on the display portion 311 when the printing sheet is set on the manual feed tray 111. On the display portion 311, there are arranged an A4 button 321, an A4R button 322, an A3 button 323, and an OK button 325. When the OK button 325 is touched by the user under a state in which any one of the buttons 321 to 323 is selected, the sheet size is determined, and information indicating the determined sheet size is stored in the RAM 303.

FIG. 4B is an illustration of display when the CPU 301 detects that the size of the printing sheet set on the manual feed tray 111 is A4 or A3 based on the positions of the side regulating plates 421. In this case, as illustrated in FIG. 4B, the A4 button 321 and the A3 button 323 are selectable, and the A4R button 322 is grayed out so as to be indicated as unselectable.

FIG. 4C is an illustration of display when the CPU 301 detects that the size of the printing sheet set on the manual feed tray 111 is A4R based on the positions of the side regulating plates 421 described above. In this case, as illustrated in FIG. 4C, the A4R button 322 is selectable, and the A4 button 321 and the A3 button 323 are grayed out and are in an unselectable state.

When the CPU 301 determines that no printing sheet is present based on the state of the sheet sensor 115 after determining the printing sheet size, the printing sheet size is undefined and the CPU 301 stores information indicating that the printing sheet size is undefined in the RAM 303. After that, when the sheet sensor 115 determines the presence of the printing sheet after the setting of the printing sheet, the sheet size selection screen is displayed again. The printing operation is not started until the printing sheet size is determined even when the start key 306 is pressed by the user.

<Description of Movement of Pickup Roller 113>

Figure 5A:
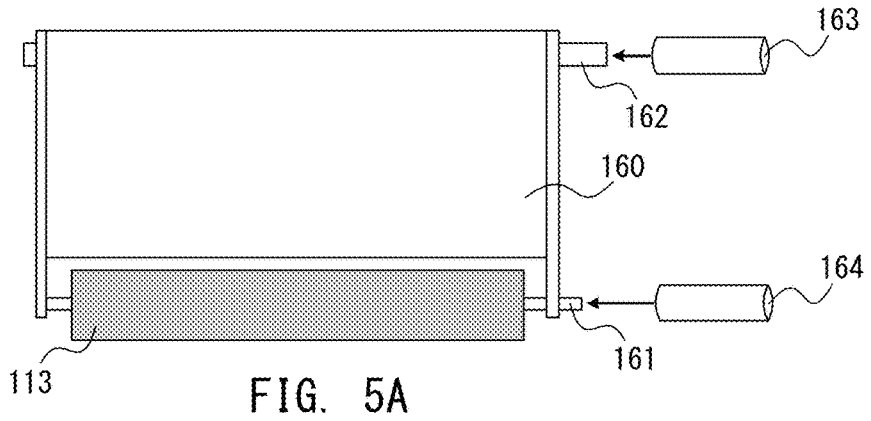
FIG. 5A and FIG. 5B are explanatory diagrams of a pickup roller raising and lowering control.
Figure 5B:
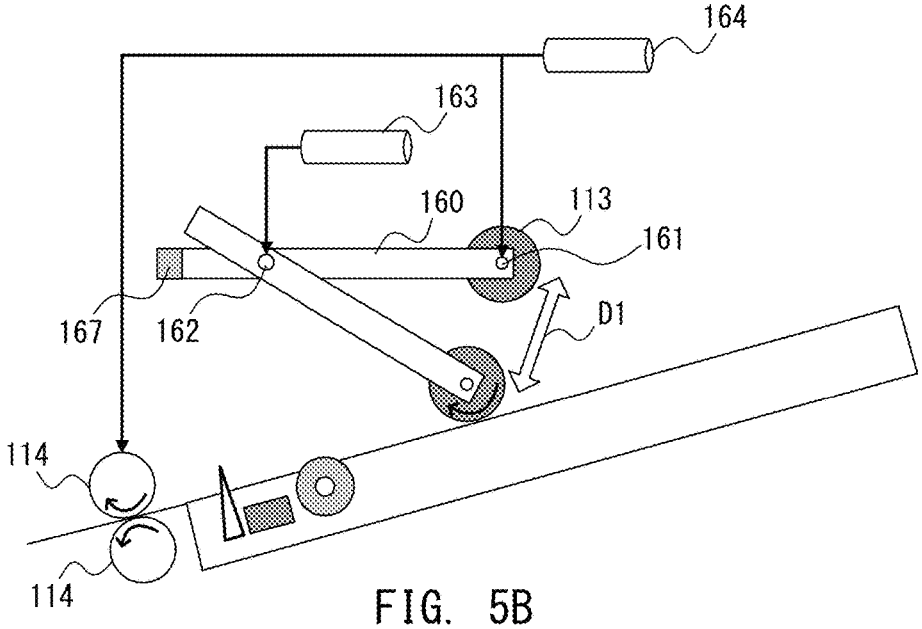
Figure 5C:
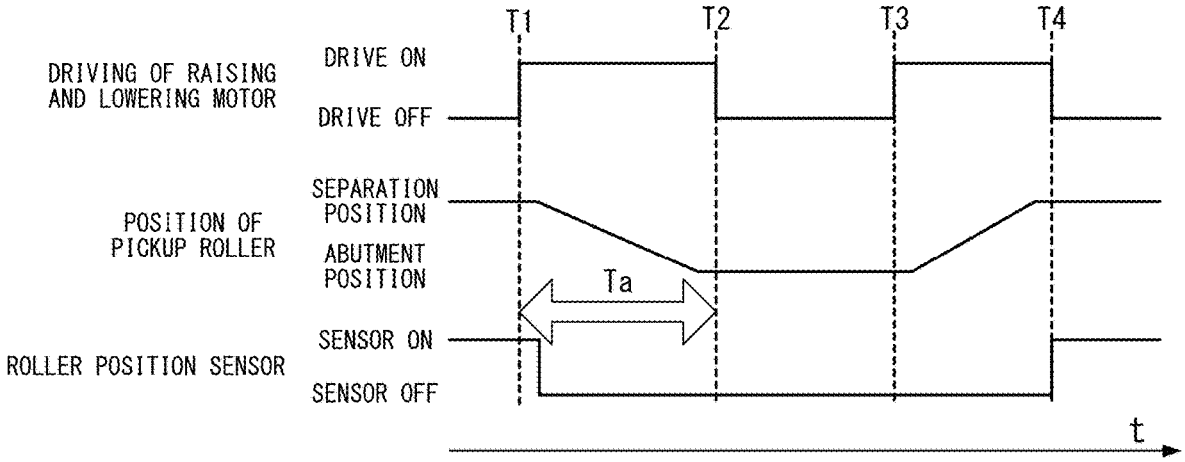
FIG. 5C is a timing chart of the pickup roller raising and lowering control.

FIG. 5A, FIG. 5B, and FIG. 5C are illustrations of a raising and lowering control of the pickup roller 113 according to this embodiment. More specifically, FIG. 5A is a projection view when the pickup roller 113 of a manual sheet feeding unit and a sheet feeding arm 160 configured to support the pickup roller 113 are viewed from above. The pickup roller 113 is supported by the sheet feeding arm 160 through intermediation of a pickup roller shaft 161. An arm shaft 162 is fixed to the sheet feeding arm 160, and is configured such that a driving force of the raising and lowering motor 163 is transmitted thereto through intermediation of a cam (not shown).

Next, the raising and lowering control of the pickup roller 113 is described with reference to FIG. 5B. FIG. 5B is a sectional view of the manual sheet feeding unit. When the raising and lowering motor 163 is driven, the arm shaft 162 is rotated within a certain angular range through intermediation of the above-mentioned cam. The arm shaft 162 is fixed to the sheet feeding arm 160, and the sheet feeding arm 160 pivots about the arm shaft 162 as a supporting point. Thus, the pickup roller 113 provided to a distal end of the sheet feeding arm 160 is raised and lowered in the directions of the arrow D1 in conjunction with the pivot of the sheet feeding arm 160.

A roller position sensor 167 operates as abutment detection means including a light-emitting portion and a light-receiving portion, which are configured to detect whether or not the pickup roller 113 is in the abutment state against a printing sheet. The light-emitting portion and the light-receiving portion are installed so that, when the pickup roller 113 is located at a position most distant from the manual feed tray 111 (pickup roller separation position), light emitted from the light-emitting portion to the light-receiving portion is blocked by the sheet feeding arm 160.

FIG. 5C is a timing chart for illustrating a relationship among a driving state of the raising and lowering motor 163, the position of the pickup roller 113, and the roller position sensor 167.

For example, in a case in which the size of a printing sheet is determined, when driving of the raising and lowering motor 163 is turned on at a timing T1, the pickup roller 113 starts lowering from the separation position. At a timing T2 after elapse of a predetermined time period Ta from the start of lowering, the CPU 301 determines that the pickup roller 113 has been moved to the abutment position which is closest to the manual feed tray 111 to be brought into abutment against the printing sheet. After that, the CPU 301 turns off the driving of the raising and lowering motor 163 to hold the pickup roller 113 at the abutment position.

As described above, in this embodiment, a printing operation start instruction is received under a state in which the pickup roller 113 is moved and located at the abutment position before the printing operation start instruction input by the user through the operation unit 330 is received. Thus, a first copy out time (FCOT) is shortened by the time period Ta (=500 ms).

Next, at a timing T3 at which the printing operation is completed, the CPU 301 turns on the driving of the raising and lowering motor 163 again, thereby causing the pickup roller 113 to start rising from the abutment position. At a timing T4 of detecting a rising edge at which the roller position sensor 167 is turned on, the CPU 301 determines that the pickup roller 113 has been moved to the separation position, and turns off the driving of the raising and lowering motor 163. The CPU 301 holds the pickup roller 113 at the separation position in the same way.

The mechanical configurations and the raising and lowering conditions of the raising and lowering motor 163, the pickup roller 113, and the roller position sensor 167, which have been described with reference to FIG. 5A to FIG. 5C, are merely examples, and the present disclosure is not limited to the configurations described above.

<Description of Lowering Determination for Pickup Roller>

Figure 6:
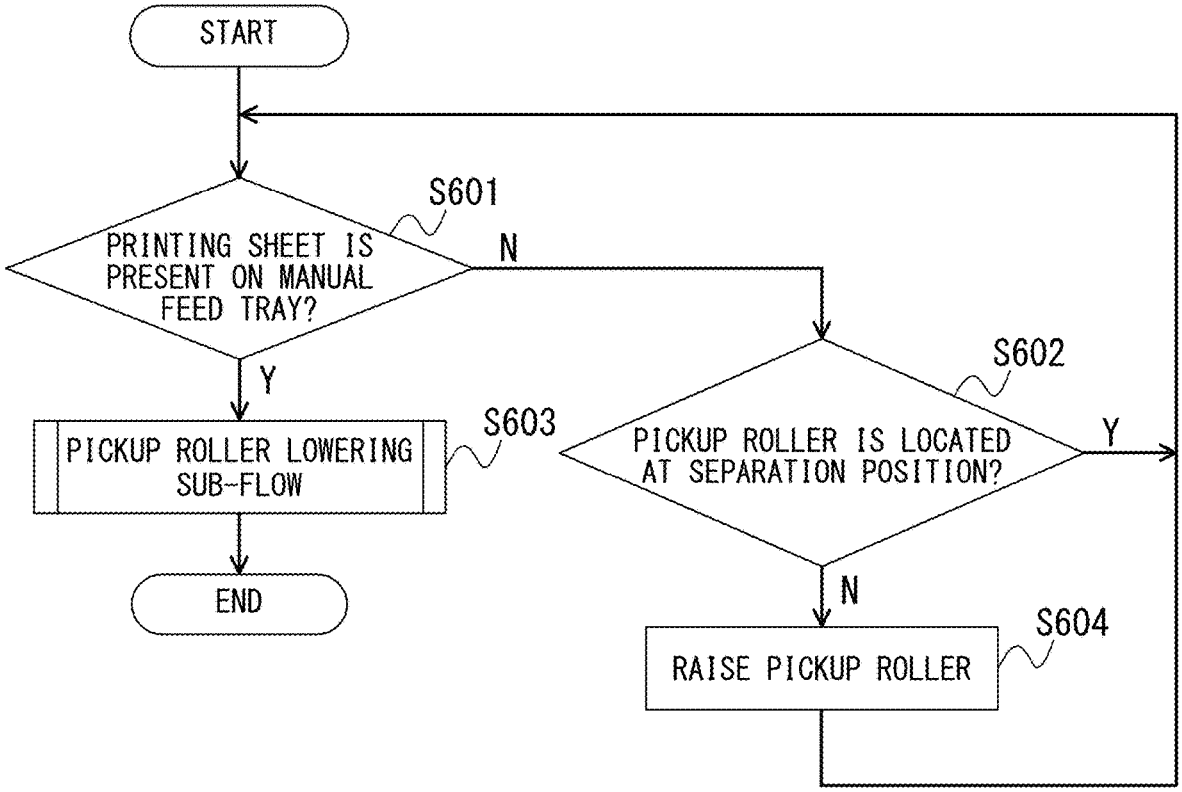
FIG. 6 is a flowchart for illustrating a pickup roller lowering control.

Next, a lowering control for the pickup roller 113 according to this embodiment is described with reference to FIG. 6. FIG. 6 is a flowchart for illustrating the lowering control for the pickup roller 113 when a printing sheet is set on the manual feed tray 111. Even when the controller 300 receives a sheet feeding request, the following operation is executed.

The CPU 301 determines whether or not a printing sheet is present on the manual feed tray 111 with use of the sheet sensor 115 (Step S601). When no printing sheet is present on the manual feed tray 111 (Step S601: N), the CPU 301 determines whether or not the pickup roller 113 is located at the separation position with use of the roller position sensor 167 (Step S602).

When the pickup roller 113 is located at the separation position (Step S602: Y), the CPU 301 executes the processing of Step S601 again. When it is determined that the pickup roller 113 is not located at the separation position (Step S602: N), the CPU 301 executes a raising control for the pickup roller 113 (Step S604) as described above with reference to FIG. 5C. In this manner, when no printing sheet is present on the manual feed tray 111, the pickup roller 113 can wait at the separation position, which contributes to improvement of usability when the user sets a printing sheet on the manual feed tray 111. When it is determined that a printing sheet is present on the manual feed tray 111 in Step S601, the CPU 301 executes a pickup roller lowering sub-flow to move the pickup roller 113 to the abutment position (Step S603). Details of the pickup roller lowering sub-flow in Step S603 are described later.

After a printing sheet is set on the manual feed tray 111 by the user through the processing described above, the CPU 301 lowers the pickup roller 113 to the abutment position to bring the manual sheet feeding unit into a printing wait state.

<Description of Pickup Roller Lowering Sub-Flow>

Figure 7:
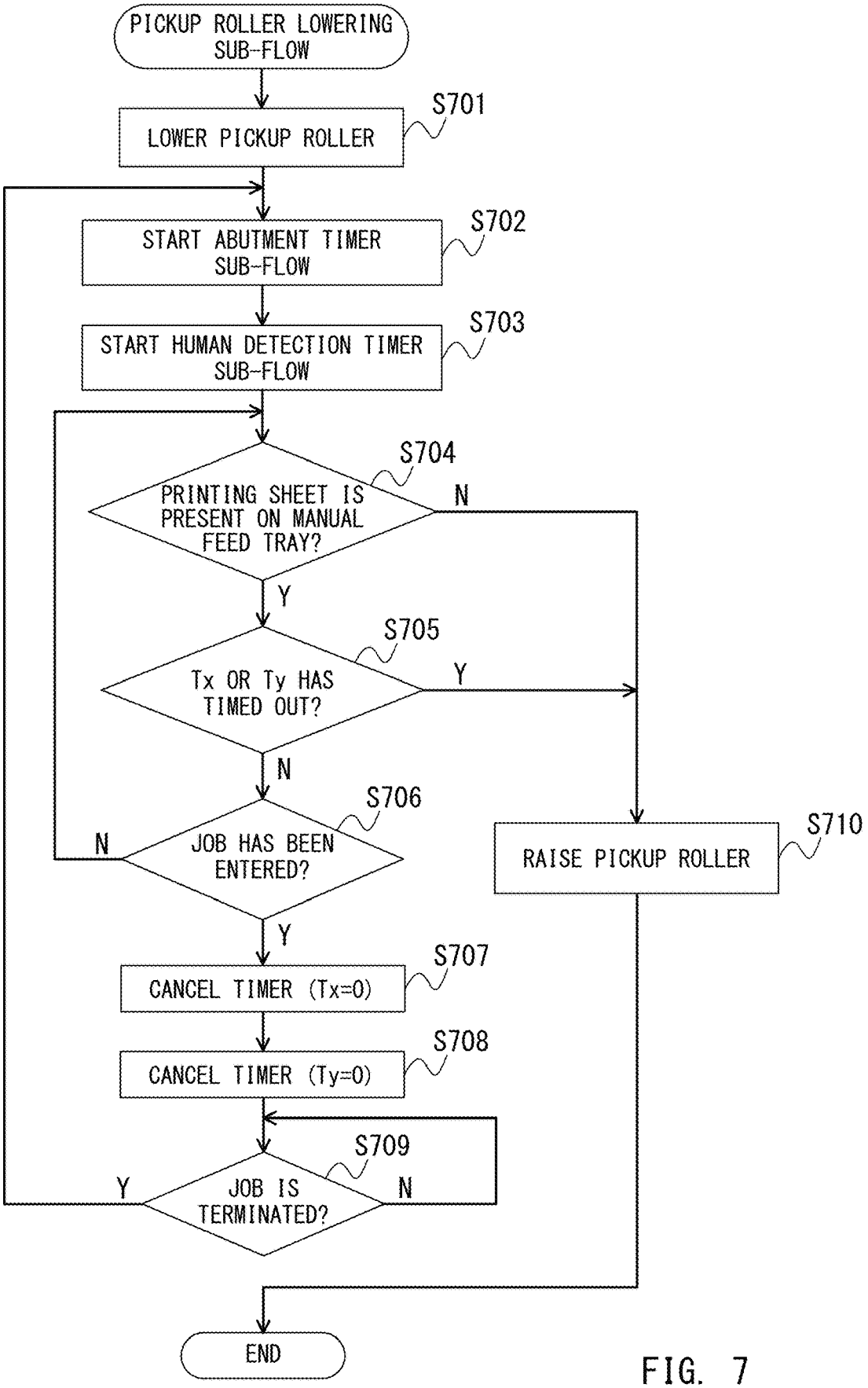
FIG. 7 is a flowchart for illustrating a pickup roller lowering sub-flow.

Next, a lowering sub-flow for the pickup roller 113 according to this embodiment is described with reference to FIG. 7. FIG. 7 is a flowchart for illustrating an operation from the abutment to the separation of the pickup roller 113. This flowchart is executed in Step S603 of FIG. 6.

First, as described above with reference to FIG. 5C, the CPU 301 lowers the pickup lower 113 (Step S701) to the abutment position. When the pickup roller 113 is already located at the abutment position, the pickup roller 113 is not required to be lowered. Next, the CPU 301 starts an abutment timer sub-flow for measuring a time period during which the pickup roller 113 is maintained at the abutment position from a predetermined measurement start time point as Tx with use of the timer 291 (Step S702). Similarly, the CPU 301 starts a human detection timer sub-flow for measuring a time period during which a state of detecting no human body is maintained from a predetermined measurement start time point as Ty with use of the timer 291 (Step S703).

Step S702 and Step S703 are not required to be started in the stated order. Step S702 and Step S703 may be executed at the same time, or the human detection timer sub-flow (Step S703) may be performed prior to the abutment timer sub-flow. The sub-flow in Step S702 and the sub-flow in Step S703 are executed by the CPU 301 in parallel to a flow after Step S704.

In the abutment timer sub-flow (Step S702), the pickup roller 113 is not raised immediately after the end of a job. Actually, in order to improve the FCOT for a next job, a lowered state of the pickup roller 113 is maintained for a predetermined period of time. The timer sub-flow is a timer operation of maintaining the lowered state of the pickup roller 113 for a predetermined period of time as described above, and details thereof are described later. In this embodiment, information indicating a series of image forming operations for a single sheet or a plurality of sheets, which includes an instruction of starting the image forming operations, is described as "job".

Meanwhile, the human detection timer sub-flow (Step S703) is a timer operation of monitoring the presence/absence of a human and measuring time when the pickup roller 113 is in the lowered state. Details of the timer operation are described later. The human detection timer sub-flow is performed for the purpose of preventing damage to the printing sheet, such as a roller trace. Through the human detection timer sub-flow, when the pickup roller 113 is located at the abutment position and no human is present around the image forming apparatus 10, the pickup roller 113 is quickly raised from the abutment position.

After the processing of Step S702 and the processing of Step S703 are executed to start the abutment timer sub-flow and the human detection timer sub-flow, the CPU 301 determines whether or not a printing sheet is present on the manual feed tray 111 with use of the sheet sensor 115 (Step S704). When no printing sheet is present on the manual feed tray 111 (Step S704: N), the CPU 301 raises the pickup roller 113 (Step S710), and then terminates the processing as described above with reference to FIG. 5C. As a result, setting of a new printing sheet when the manual feed tray 111 is out of printing sheets is facilitated, thereby enabling the improvement of usability.

When a printing sheet is present on the manual feed tray 111 (Step S704: Y), the CPU 301 determines whether any one of Tx which starts being measured in Step S702 and Ty which starts being measured in Step S703 has timed out (Step S705). Timeout results of Tx and Ty are recorded on the RAM 303. The CPU 301 determines whether any one of Tx and Ty has timed out with reference to the timeout results recorded on the RAM 303. Details of the determination are described later. When any one of Tx and Ty has timed out (Step S705: Y), the CPU 301 raises the pickup roller 113.

Through the control using the two timers described above, when a human is present in the vicinity of the image forming apparatus 10, the pickup roller 113 is maintained at the abutment position. Thus, the FCOT for performing a next job is improved. After the human leaves the vicinity of the image forming apparatus 10, the pickup roller 113 is moved from the abutment position to the non-abutment position. Thus, damage, which may be caused by the pickup roller 113 remaining at the abutment position for a long period of time, such as a roller trace, can also be prevented. Thus, timeout time of the human detection timer is set shorter than timeout time of the abutment timer. In this manner, a time period during which the pickup roller 113 is located at the abutment position can be shortened as much as possible while the FCOT is shortened by maintaining the pickup roller 113 at the abutment position even after the end of the job. Thus, damage to the original can be suppressed.

When none of Tx and Ty has timed out (Step S705: N), the CPU 301 determines whether or not a job has been entered (Step S706). When a job has not been entered (Step S706: N), the CPU 301 executes Step S704 again. When a job has been entered (Step S706: Y), the CPU 301 performs a sheet feeding operation for the printing sheet on the manual feed tray 111. The pickup roller 113 is not required to be raised from the abutment position at the time of the sheet feeding operation. Thus, the CPU 301 uses the timer 291 to cancel the abutment timer to set Tx equal to zero (Step S707). Similarly, the CPU 301 cancels the human detection timer to set Ty equal to zero (Step S708). Similarly to Step S702 and Step S703, the processing of Step S707 and the processing of Step S708 may be executed at the same time, or the processing of Step S708 may be executed prior to the processing of Step S707.

Thereafter, the CPU 301 determines whether or not the job has been terminated (Step S709). When the job has not been terminated (Step S709: N), the processing of Step S709 is executed again. When the job has been terminated (Step S709: Y), the processing of Step S702 is executed again. Through the return to Step S702 as described above, the flow for raising the pickup roller 113 again after the termination of the job can be continued under a state in which the pickup roller 113 is located at the abutment position.

<Description of Abutment Timer Sub-Flow>

Figures 8A, 8B:
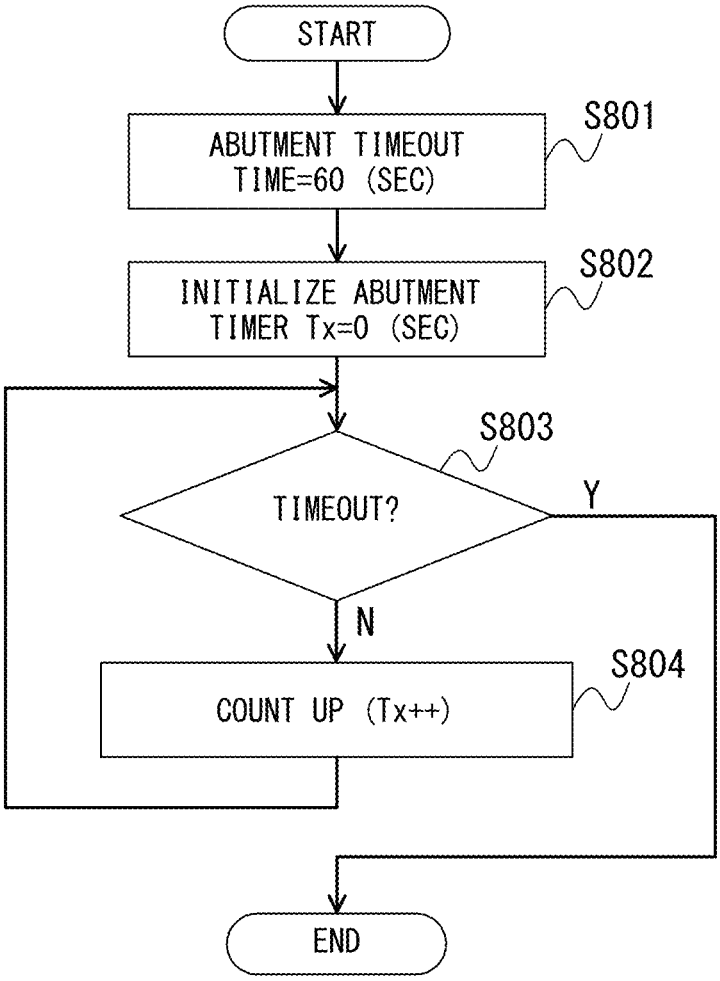
FIG. 8A is a flowchart for illustrating an abutment timer sub-flow.
FIG. 8B is a table for showing timeout time.

FIG. 8A is a flowchart for illustrating the abutment timer sub-flow according to this embodiment. In the flowchart, there is illustrated a timer operation of maintaining a state in which the pickup roller 113 is located at the abutment position. Further, a table for showing the timeout time of the abutment timer and the timeout time of the human detection timer is shown in FIG. 8B.

After the pickup roller 113 is lowered to the abutment position in Step S701 of FIG. 7, the CPU 301 refers to the timeout time of the abutment timer shown in FIG. 8B. Then, the CPU 301 records the timeout time of the abutment timer (abutment timeout time) as sixty seconds on the RAM 303 (Step S801). A value of the timeout time recorded in the table is set so as to reduce the roller trace, which is generated due to the abutment of the pickup roller 113 against the printing sheet, and also in consideration of an influence on the FCOT for a next job. In this embodiment, the value of the timeout time is set to sixty seconds as an experimentally obtained value. Thus, the above-mentioned value of the abutment timeout time is merely an example, and other values may be used.

Next, the CPU 301 initializes the abutment timer to set Tx equal to zero (Step S802). When the processing of Step S802 is executed after the processing of Step S701, the measurement start time point of the abutment timer corresponds to a point of time when the pickup roller 113 is brought into abutment against the original. Meanwhile, when the processing of Step S802 is executed after the termination of the job in Step S709, the measurement start time point of the abutment timer corresponds to a point of time when the job is terminated (point of time when the image forming processing is completed).

In Step S803, the CPU 301 compares the abutment timeout time (sixty seconds) and time indicated by a count value of the abutment timer to determine whether or not a timeout has occurred. When the time indicated by the count value of the abutment timer has not reached the abutment timeout time, the CPU 301 does not determine that a timeout has occurred, and thus the value of Tx is counted up by the timer 291 (TX++).

When the time indicated by the count value of the abutment timer has reached the abutment timeout time as a result of repeated count-up of the count value of the abutment timer, the CPU 301 records the result of a timeout on the RAM 303, and then terminates the abutment timer sub-flow processing. The result recorded on the RAM 303 in the abutment timer sub-flow processing is used for the determination in Step S705 of the flowchart of FIG. 7.

<Description of Human Detection Timer Sub-Flow>

Figure 9:
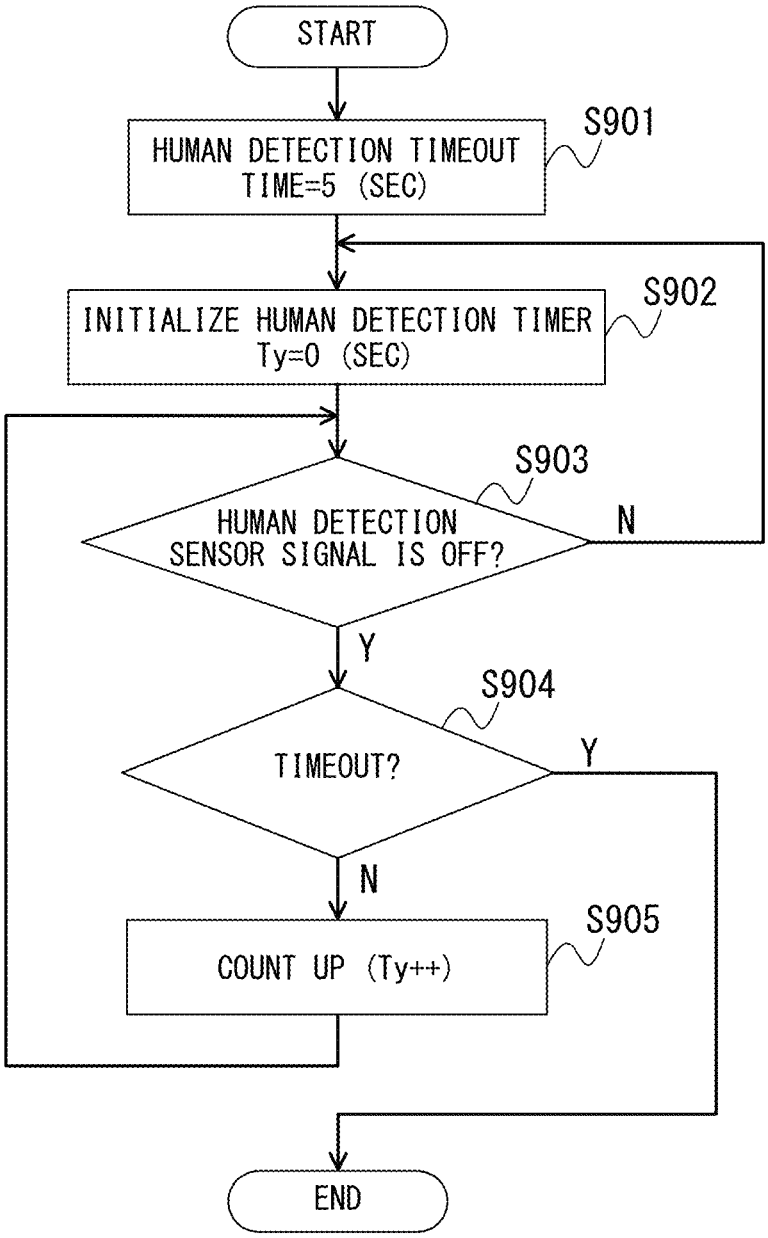
FIG. 9 is a flowchart for illustrating a human detection timer sub-flow.

Next, the human detection timer sub-flow according to this embodiment is described with reference to FIG. 9. FIG. 9 is a flowchart for illustrating a human detection timer operation of detecting the absence of a human in the vicinity of the image forming apparatus 10 with use of the human detection sensor under a state in which the pickup roller 113 is located at the abutment position. The timeout time of the human detection timer is described with reference to the table of FIG. 8B.

After the human detection timer sub-flow is started, the CPU 301 refers to the timeout time of the human detection timer (human detection timeout time), which is shown in FIG. 8B, to record five seconds as the human detection timeout time on the RAM 303 (Step S901). When no human is present in the vicinity of the image forming apparatus 10, there is a low possibility that a next job (copy) may be entered. Thus, the timeout time recorded in the table is set so as to quickly raise the pickup roller 113 in accordance with a time when a human leaves the vicinity of the image forming apparatus 10 to reduce a roller trace. In this embodiment, the human detection timeout time is set to five seconds. However, the value of the human detection timeout time is merely an example, and other values may be used.

After the human detection timeout time is recorded on the RAM 303, the CPU 301 initializes the human detection timer to set Ty equal to zero (Step S902). When the processing of Step S902 is executed after the processing of Step S701, the measurement start time point of the human detection timer corresponds to a point of time when the pickup roller 113 is brought into abutment against the original. Meanwhile, when the processing of Step S902 is executed after the termination of the job in Step S709, the measurement start time point of the human detection timer corresponds to a point of time when the job is terminated (a point of time when the image forming processing is completed).

Next, the CPU 301 determines whether or not a human is present in the vicinity of the image forming apparatus 10 with use of the human detection sensor 331 (Step S903). When it is determined that a human is present (Step S903: N), the CPU 301 executes the processing of Step S902 again. When it is determined that a human is present, the initialization of the human detection timer is repeated in Step S902. Thus, when the processing of Step S902 is executed after the processing of Step S903, the measurement start time point of the human detection time corresponds to a point of time when a human leaves and the detection of the human is stopped.

When it is determined that no human is present (Step S903: Y), the CPU 301 compares the human detection timeout time (five seconds) and time indicated by a count value of the human detection timer to determine whether or not a timeout has occurred.

When the time indicated by the count value of the human detection timer has not reached the human detection timeout time, the CPU 301 does not determine that a timeout has occurred, and thus the value of the human detection timer is counted up by the timer 291 (Ty++). When the time indicated by the count value of the human detection timer has reached the human detection timeout time as a result of repeated count-up of the human detection timer, the CPU 301 records the result of timeout on the RAM 303, and then terminates the human detection timer sub-flow processing. Similarly to the abutment timer, the result recorded on the RAM 303 is used for the determination in Step S705 of the flowchart of FIG. 7. Through the processing described above, the CPU 301 can count a time period during which a human is not present in the vicinity of the image forming apparatus 10 with use of the human detection sensor 331.

Next, a relationship between the abutment timer and the human detection timer on the timeout time table of FIG. 8B is described. A purpose of counting the abutment timer and the human detection timer is to reduce damage to a printing sheet under a state in which the pickup roller 113 is located at the abutment position, such as a roller trace. For the above-mentioned purpose, it is preferred that the timeout time of the human detection timer for detecting a human be set shorter than the timeout time of the abutment timer for counting the time period during which the pickup roller 113 is located at the abutment position.

In some cases, even when a human is present in the vicinity of the image forming apparatus 10, the human may be merely passing by the image forming apparatus 10 without performing the image formation. In such a case, when the pickup roller 113 is maintained at the abutment position while a human is present in the vicinity of the image forming apparatus 10, the pickup roller 113 may be maintained at the abutment position for a long period of time although the image formation is not performed. In order to reduce the above-mentioned risk, it is preferred that the timeout time of the human detection timer be shorter than the timeout time of the abutment timer for counting the time period during which the pickup roller 113 is located at the abutment position.

As another mode, a human detection sensor 331 capable of detecting a distance between the image forming apparatus 10 and a human may be used to function as a distance detection unit so as to dynamically set the human detection timeout time. In this case, when a condition that the distance between the image forming apparatus 10 and the human is larger than a threshold value or a condition that the distance between the image forming apparatus 10 and a human is increased is satisfied, there is a low probability that the image formation (copy) may be performed by the image forming apparatus 10. Thus, the CPU 301 sets the human detection timeout time shorter than that when the above-mentioned condition is satisfied. In this manner, the time period during which the pickup roller 113 is located at the abutment position can be shortened to reduce damage to the original. The threshold value in this case may be suitably set. For example, the threshold value may be set as a distance that allows a human to reach (operate) the image forming apparatus 10.

Meanwhile, when the distance between the image forming apparatus 10 and a human is short or when a distance between the image forming apparatus 10 and a human is not increased, there is a high probability that the image formation may be performed with the image forming apparatus 10. Thus, the human detection timeout time is set long. In this manner, a time period during which the pickup roller 113 is located at the abutment position can be increased to shorten the FCOT at the time of execution of a next job.

As described above, according to the present disclosure, the pickup roller 113 is maintained at the abutment position to keep a sheet feeding enabled state over the abutment timeout time even after the end of the job. As a result, the FCOT at the time of execution of a next job after the user terminates the job can be improved. Further, after a state in which the user does not use the image forming apparatus, specifically, a state in which a human is not present in the vicinity of the image forming apparatus 10 is detected over the human detection timeout time, the pickup roller 113 is moved from the abutment position to release a pressing force applied by the pickup roller 113 to a printing sheet.

In this manner, a time period during which the pickup roller 113 is located at the abutment position is shortened to prevent damage such as a roller trace. Further, when no printing sheet is present on the sheet feeding tray or the manual feed tray, the sheet feeding pickup roller is moved from the abutment position. Thus, refill of printing sheets can be performed under the above-mentioned state. As a result, a user can quickly perform refill when the sheet runs out. Accordingly, damage to a printing sheet, such as a roller trace, can be prevented without impairing usability at the time of refill of printing sheets.

According to the present disclosure, a sheet feeding apparatus capable of feeding a sheet while improving the operability for a user without damaging a sheet on the sheet feed tray can be provided.

There has been described the example in which the present disclosure is applied to an image forming apparatus. However, the present disclosure is also applicable to an apparatus other than the image forming apparatus. For example, the present disclosure is also applicable to, for example, a sheet feeding apparatus configured to feed a sheet to an apparatus configured to perform predetermined processing on the sheet. In this case, the sheet feeding apparatus includes the manual feed tray 111, the pickup roller 113, the raising and lowering motor 163, the CPU 301 serving as control means, and the human detection sensor 331. The sheet feeding apparatus feeds a sheet to the apparatus configured to perform the predetermined processing on the sheet and, when the human detection timeout or the abutment timeout is detected, brings the pickup roller 113 into the non-abutment state against the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-175997, filed Sep. 20, 2018, which is hereby incorporated by reference herein in its entirety.

What is claimed is:

1. An image forming apparatus, comprising:

a sheet feeding tray on which a sheet to be subjected to image formation is placed;

a sheet feeder configured to abut against the sheet placed on the sheet feeding tray to feed the sheet;

a moving unit configured to move at least one of the sheet feeder and the sheet feeding tray to cause one of an abutment state in which the sheet feeder is held in abutment against the sheet on the sheet feeding tray and a separated state in which the sheet feeder is not held in abutment against the sheet on the sheet feeding tray;

a human detector configured to detect a human being present in a vicinity of the image forming apparatus; and a controller configured to control the moving unit to cause the separated state in which the sheet feeder is not held in abutment against the sheet on the sheet feeding tray after an elapse of a predetermined timeout time without receiving an instruction of starting image formation and the apparatus being in the abutment state in which the sheet feeder is held in abutment against the sheet on the sheet feeding tray, wherein in a state in which the human detector detects a human, the controller is configured to control the moving unit to cause the separated state after an elapse of a first time period as the predetermined timeout time, and wherein, in a case in which the human detector changes from a state in which the human is detected to a state in which the human is not detected, the controller is configured to control the moving unit to cause the separated state even if the first time period is not yet elapsed after an elapse of a second time period as the predetermined timeout time, the second time period being shorter than the first time period.

2. The image forming apparatus according to claim 1, wherein the sheet feeding tray comprises a manual feed tray.

3. The image forming apparatus according to claim 1, wherein a measurement of the first time period is started at one of 1) a point of time when abutment of the sheet feeder against the sheet is caused and 2) a point of time when the image forming apparatus completes image formation processing using the sheet feeding tray.

4. The image forming apparatus according to claim 1, wherein a measurement of the second time period is started at a point of time when the human detected by the human detector leaves the vicinity of the image forming apparatus and becomes undetectable.

5. The image forming apparatus according to claim 1, wherein the controller controls the moving unit so as to maintain the abutment state while the sheet feeder is performing a sheet feeding operation.

6. The image forming apparatus according to claim 1, further comprising a sheet detector configured to detect whether or not the sheet is placed on the sheet feeding tray, wherein, in a case in which the sheet detector detects that the sheet is placed on the sheet feeding tray, the controller controls the moving unit so as to cause the abutment state.

7. The image forming apparatus according to claim 1, further comprising an abutment detector configured to detect whether or not the apparatus is in the abutment state, wherein the controller is configured to control, in a case in which the abutment detector detects that the apparatus is not in the abutment state when the controller receives a request for feeding the sheet placed on the sheet feeding tray, the moving unit to cause the abutment state.

8. The image forming apparatus according to claim 1, wherein the moving unit comprises a motor configured to raise and lower the sheet feeder, and wherein the controller controls the motor to move the sheet feeder so as to cause the abutment state.

9. The image forming apparatus according to claim 1, wherein the moving unit comprises a motor configured to raise and lower the sheet feeding tray, and wherein the controller controls the motor to move the sheet feeding tray so as cause the abutment state.

10. An image forming apparatus, comprising:

a sheet feeding tray on which a sheet to be subjected to image formation is placed;

a sheet feeder configured to abut against the sheet placed on the sheet feeding tray to feed the sheet;

a moving unit configured to move at least one of the sheet feeder and the sheet feeding tray to cause one of an abutment state in which the sheet feeder is held in abutment against the sheet on the sheet feeding tray and a separated state in which the sheet feeder is not held in abutment against the sheet on the sheet feeding tray;

a distance detector configured to detect a distance between the image forming apparatus and a human; and a controller configured to control the moving unit to cause the separated state in which the sheet feeder is not held in abutment against the sheet after an elapse of a predetermined timeout time without receiving an instruction of starting image formation, wherein the controller is configured to set a first time period as the predetermined timeout time in a case in which the distance detected by the distance detector is a first distance, and is configured to set a second time period, which is shorter than the first time period, as the predetermined timeout time in a case in which the distance detected by the distance detector is a second distance longer than the first distance.

11. A sheet feeding apparatus configured to feed a sheet to an apparatus configured to perform predetermined processing for the sheet, the sheet feeding apparatus comprising:

a sheet feeding tray on which a sheet to be subjected to image formation is placed;

a sheet feeder configured to abut against the sheet placed on the sheet feeding tray to feed the sheet;

a moving unit configured to move at least one of the sheet feeder and the sheet feeding tray to cause one of an abutment state in which the sheet feeder is held in abutment against the sheet on the sheet feeding tray and a separated state in which the sheet feeder is not held in abutment against the sheet on the sheet feeding tray;

a human detector configured to detect a human being present in a vicinity of the image forming apparatus; and a controller configured to control the moving unit to cause the separated state in which the sheet feeder is not held in abutment against the sheet on the sheet feeding tray after an elapse of a predetermined timeout time without receiving an instruction of starting image formation and the apparatus being in the abutment state in which the sheet feeder is held in abutment against the sheet on the sheet feeding tray, wherein in a state in which the human detector detects a human, the controller is configured to control the moving unit to cause the separated state after an elapse of a first time period as the predetermined timeout time, and wherein, in a case in which the human detector changes from a state in which the human is detected to a state in which the human is not detected, the controller is configured to control the moving unit to cause the separated state even if the first time period is not yet elapsed after an elapse of a second time period as the predetermined timeout time, the second time period being shorter than the first time period.

* * * * *